US007558514B2

(12) United States Patent
Yamamura

(10) Patent No.: US 7,558,514 B2
(45) Date of Patent: Jul. 7, 2009

(54) TONER SUPPLY DEVICE

(75) Inventor: Kazuyoshi Yamamura, Osaka (JP)

(73) Assignee: Kyocera Mita Corporation (JP)

( * ) Notice: Subject to any disclaimer, the term of this patent is extended or adjusted under 35 U.S.C. 154(b) by 477 days.

(21) Appl. No.: 11/375,218

(22) Filed: Mar. 14, 2006

(65) Prior Publication Data

US 2006/0222414 A1 Oct. 5, 2006

(30) Foreign Application Priority Data

Mar. 30, 2005 (JP) ..... 2005-097477

(51) Int. Cl.
*G03G 15/08* (2006.01)

(52) U.S. Cl. ..... 399/256; 399/263

(58) Field of Classification Search ..... 399/254, 399/256, 263
See application file for complete search history.

(56) References Cited

U.S. PATENT DOCUMENTS 5,202,732 A * 4/1993 Yahata ..... 399/263
5,752,145 A * 5/1998 Nakaue et al. ..... 399/256
6,289,197 B1 * 9/2001 Matsumoto et al. ..... 399/254 X
6,385,422 B1 * 5/2002 Ishiguro et al. ..... 399/263 X

FOREIGN PATENT DOCUMENTS

JP 3462860 8/2003
JP 2004-219801 8/2004

* cited by examiner

*Primary Examiner*—Sandra L Brase
(74) *Attorney, Agent, or Firm*—Gerald E. Hespos; Anthony J. Casella

(57) ABSTRACT

Disclosed is a toner supply device including a toner container section (21*b*), a rotating shaft (31) provided in the toner container section (21*b*), and a stirring member (32) for stirring and feeding toner T to a supply opening (21*d*) formed in the toner container section (21*b*). The stirring member (32) includes an attachment portion (32*c*) fixedly attached to the rotating shaft (31) and a free end portion (32*d*) free to the rotating shaft (31). The free end portion (32*d*) has a stiffness lower than the attachment portion (32*c*). With this construction, a toner feeding rate can be maintained by the attachment portion (32*c*) and sound occurring at a release of the free end portion (32*d*) can be suppressed due to the free end portion (32*d*).

7 Claims, 5 Drawing Sheets

TONER SUPPLY DEVICE

BACKGROUND OF THE INVENTION

1. Field of the Invention

The present invention relates to a toner supply device used for an image forming apparatus, such as an electro-photographic copying machine, a laser printer.

2. Description of the Related Art

Heretofore, an image forming apparatus is provided with a toner supply device which supplies toner from a supply opening to a developing section of the image forming apparatus, as disclosed in Japanese Patent No. 3462860. The toner supply device is provided with a toner container section. In the toner container section, a flexible stirring member attached to a rotating shaft is rotated so as to stir and feed toner particles to the supply opening on a downstream by scooping up toner particles along a wall standing on the downstream.

In the case of using a sheet made of a synthetic resin such as PET (polyethylene terephthalate) as the stirring member, a thicker sheet (e.g., a thickness of 0.125 mm, having a high stiffness) causes the toner feeding rate of the stirring member higher.

However, when a free end of the stirring member is released from an upper end of the standing wall on the downstream in the toner container section, loud sound occurs due to a restoration of the stirring member to the liner shape since the stirring member has the high stiffness and a strong resilience.

SUMMARY OF THE INVENTION

In view of the above problems, it is an object of the present invention to provide a toner supply device which can suppress sounds when a stirring member is released, while maintaining a toner feeding rate of the stirring member.

In order to solve the problem, according to an aspect of the invention, in a toner supply device including a toner container section for containing toner particles, a rotating shaft provided in the toner container section, and a stirring member attached to the rotating shaft for stirring and feeding the toner to a supply opening, the stirring member includes an attachment portion fixedly attached to the rotating shaft and a free end portion having a stiffness lower than the attachment portion.

With this construction, the attachment portion of the stirring member has a high stiffness, and the free end portion has a stiffness lower than the attachment portion. Accordingly, the attachment portion having a high stiffness scoops up toner particles along a standing wall thereby maintaining the toner feeding rate of the stirring member. Further, when the free end portion of the stirring member is released from an upper portion of the standing wall and restores a liner shape of the stirring member, the sound occurring at the release is suppressed since the free end portion has the lower stiffness and a weak resilience.

BRIEF DESCRIPTION OF THE DRAWINGS

FIGS. 2A and 2B show a toner cartridge according to the embodiment of the present invention, wherein FIG. 2A is a cross sectional view from side, and FIG. 2B is a cross sectional view from side showing a main portion.

FIGS. 4A and 4B show a stirring member, wherein FIG. 4A is a perspective view, and FIG. 4B is a perspective view in the case where the stirring member is attached to a rotating shaft.

FIGS. 5A and 5B show the stirring member, wherein FIG. 5A is an exploded perspective view, and FIG. 5B is a perspective view showing a modified embodiment.

DETAILED DESCRIPTION OF THE PREFERRED EMBODIMENTS

Figure 1:
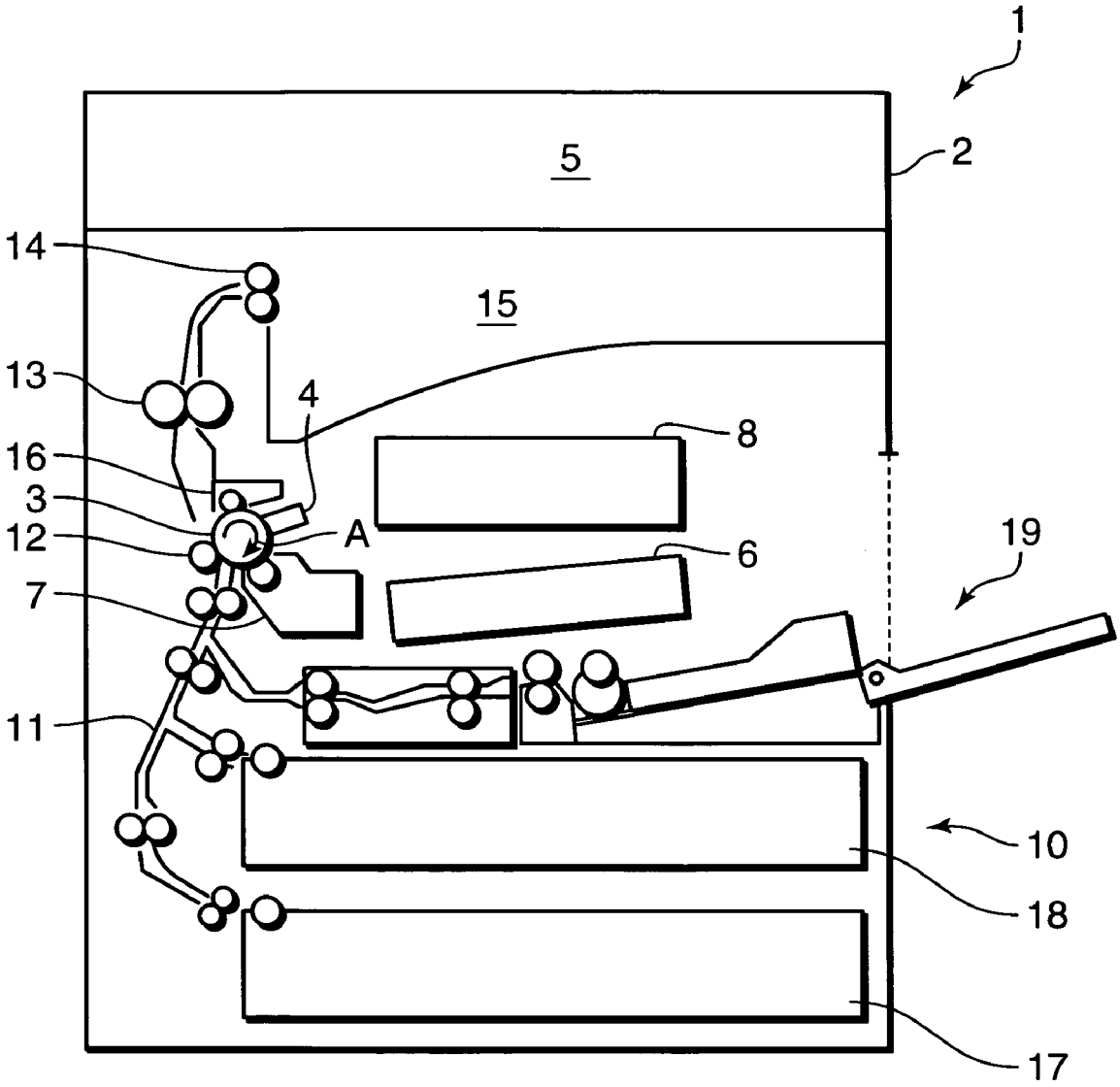
FIG. 1 is a schematic diagram showing a framework of an electro-photographic copying machine provided with a toner supply device according to an embodiment of the present invention.

FIG. 1 is a schematic diagram showing a framework of an electro-photographic copying machine 1, as an example of image forming apparatuses. In a main body 2 of the copying machine 1, a photoconductive drum 3 rotating in a direction A in FIG. 1 is charged in a charging section 4, an electrostatic image is formed on a peripheral surface of the photoconductive drum 3 by a laser beam from a laser scanning unit (LSU) 6 in accordance with an original image read in an image reading section 5, and toner is adhered to the electrostatic image in a developing section 7 so as to form a toner image. A toner supply device 8 supplies the toner to the developing section 7. Details of the toner supply device 8 are described later.

As mentioned above, a sheet is fed from a sheet feeding mechanism 10 via a sheet feeding passage 11 to the photoconductive drum 3 on which the toner image has been formed. The toner image formed on the photoconductive drum 3 is transferred onto the sheet by a transferring roller 12. Then, the sheet on which the toner image has been transferred is separated from the photoconductive drum 3 to be conveyed to a pair of fixing rollers 13. The sheet on which the toner image has been fixed is discharged by a pair of discharging rollers 14 to a discharging section 15 without further processing, or after being performed with both-side copying by using an un-illustrated switchback.

The reference numeral 16 indicates a cleaning section for removing the remaining toner from the peripheral surface of the photoconductive drum 3. The sheet feeding mechanism 10 is detachably attached to the main body 2, and includes paper feeding cassettes 17 and 18, and a stuck bypass (a bypass tray) 19 in such a manner that all of these sections are connected to the sheet feeding passage 11.

Figure 2A:
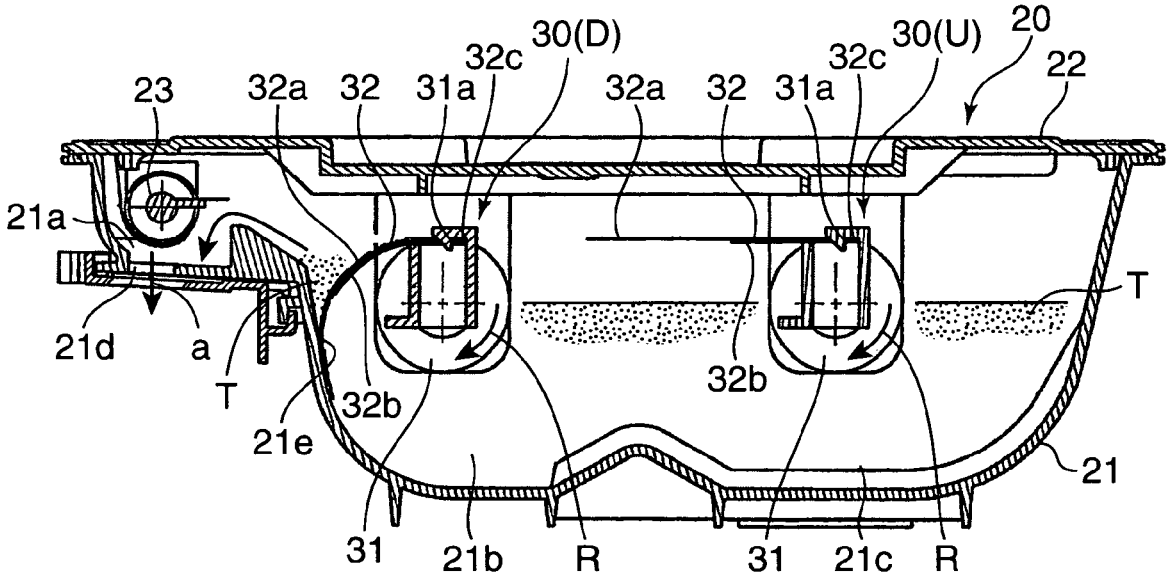
Figure 2B:
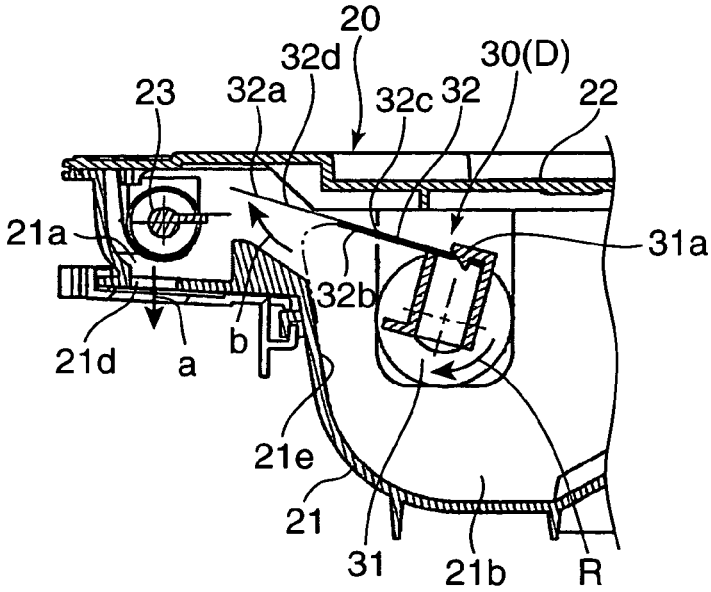
Figure 3:
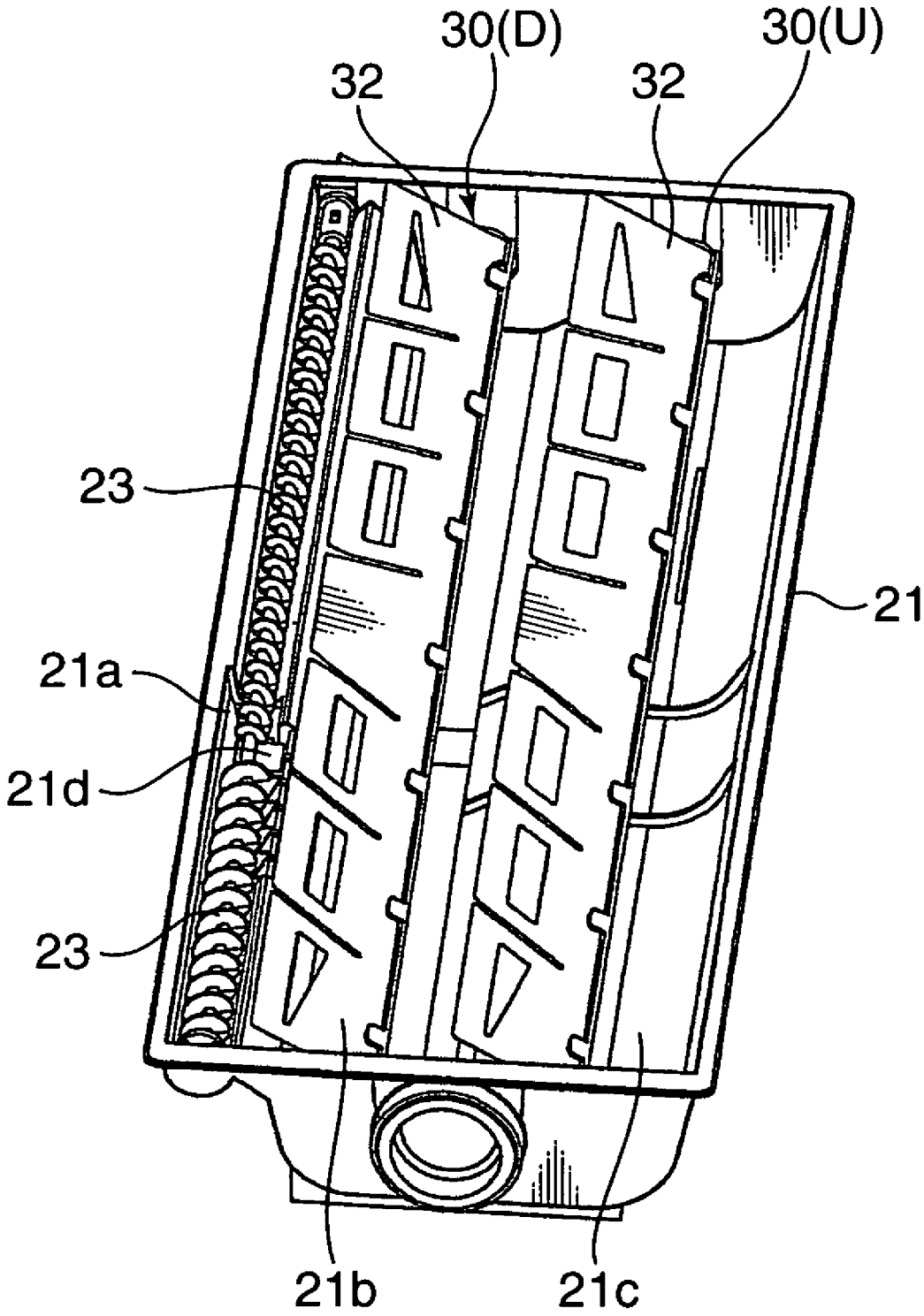
FIG. 3 is a perspective view showing a cartridge main body.

The toner supply device 8 is provided with a toner cartridge 20 detachably mounted on the main body 2 as shown in detail in FIGS. 2 and 3.

The toner cartridge 20 includes a box-shaped cartridge main body 21 having a bottom and a lid 22 which closes an upper opening of the cartridge main body 21. The lid 22 is not shown in the FIG. 3.

The cartridge main body 21 is provided with a toner supplying section 21*a*, a plurality of toner container sections 21*b*, and 21*c* for containing a great amount of toner particles T.

A supply opening 21*d* for supplying toner to the developing section 7 (see an array a in the FIG. 2A) is formed in a bottom wall of the toner supplying section 21*a*. The toner supplying section 21*a* is provided with a screw conveyer 23 for feeding toner particles T in the toner supplying section 21 toward the supply opening 21*d*.

The toner container sections 21*b* and 21*c* are respectively provided with toner feeding mechanisms 30(D), and 30(U) for feeding the toner toward the toner supplying section 21*a*.

Each of the toner feeding mechanisms 30(D) and 30(U) includes a rotating shaft 31 and a flexible stirring member 32 fixedly attached to the rotating shaft 31.

Both ends of each of the rotating shafts 31, not shown in detail, are rotatably supported at both side walls of the cartridge main body 21. A gear is fixedly attached to an outwardly projecting end of each of the rotating shaft 31. An intermediate gear is provided between the gears mounted on the respective projecting ends of the rotating shafts 31 to thereby rotate the shafts 31 in the same direction (in a clockwise direction R in FIG. 2A). Both ends of the screw conveyer 23 in the toner supplying section 21*a* are also rotatably supported in the both side walls of the cartridge main body 21, and a gear is further mounted with the one of the ends that projects outwardly form one of the side walls. The gear of the screw conveyer 23 is engaged with the gear of the rotating shaft 31 of the toner feeding mechanism 30(D) provided on the downstream.

In the state where the toner cartridge 20 is set in the main body 2, one of the gears mounted on the rotating shafts 31, the gear mounted on the screw conveyer 23, and the intermediate gear is engaged with a driving gear provided in the machine main body 2 so as to synchronously rotate the screw conveyer 23 and the both rotating shafts 31.

When the rotating shafts 31 of the toner feeding mechanism 30(D) and 30(U) rotate in the clockwise direction R, the respective flexible stirring members 32 fixedly attached to the rotating shafts 31 also rotate in the clockwise direction R so that toner particles T in the respective toner container sections 21*b*, 21*c* is stirred with the rotation of the stirring members 32. The stirring member 32 of the toner feeding mechanism 30(U) provided on the upstream feeds toner particles T from the toner container section 21*c* to the toner container section 2*b* on the downstream.

Further, the stirring member 32 of the toner feeding mechanism 30(D) provided on the downstream feeds toner particles T in the toner container section 21*b* on the downstream to the toner supplying section 21*a* provided on the further downstream by scooping up it along a stand wall 21*e* on the downstream.

Toner particles T in the toner supplying section 21*a* is gathered near the supply opening 21*d* by the rotation of the screw conveyer 23, and then supplied to the developing section 7 from the supply opening 21*d*.

Figure 4A:
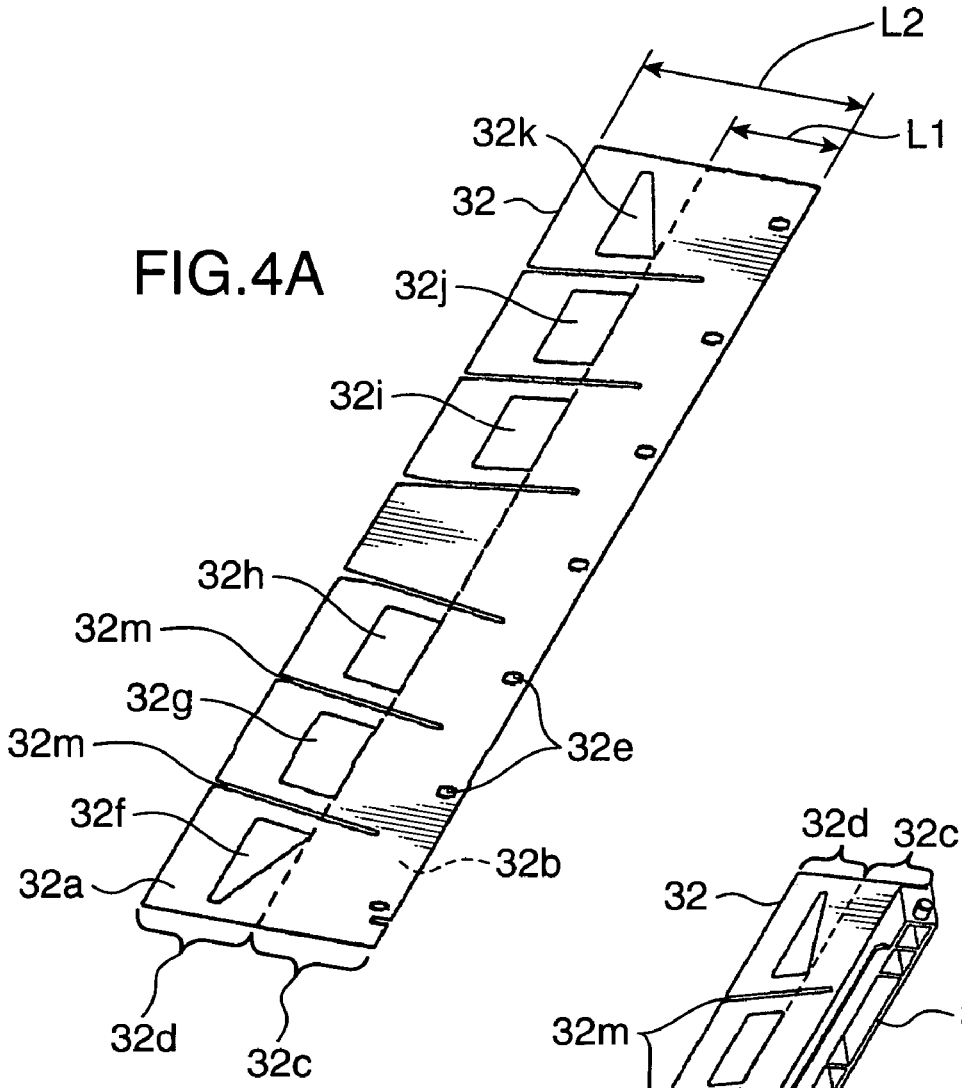

As shown in FIGS. 2A and 2B, the stirring member 32 is attached to the rotating shaft 31 by inserting an end portion of an attachment portion 32*c* of the stirring member 32 into a slit formed in the rotating shaft 31 in an axis direction, and allowing a hook hole 32*e* formed in the stirring member 32 to engage a hook claw 31*a* formed on the rotating shaft 31 (see FIG. 4A). Accordingly, the stirring member 32 is easily attached to the rotating shaft 31, that is, in one-touch attachment.

Figure 5A:
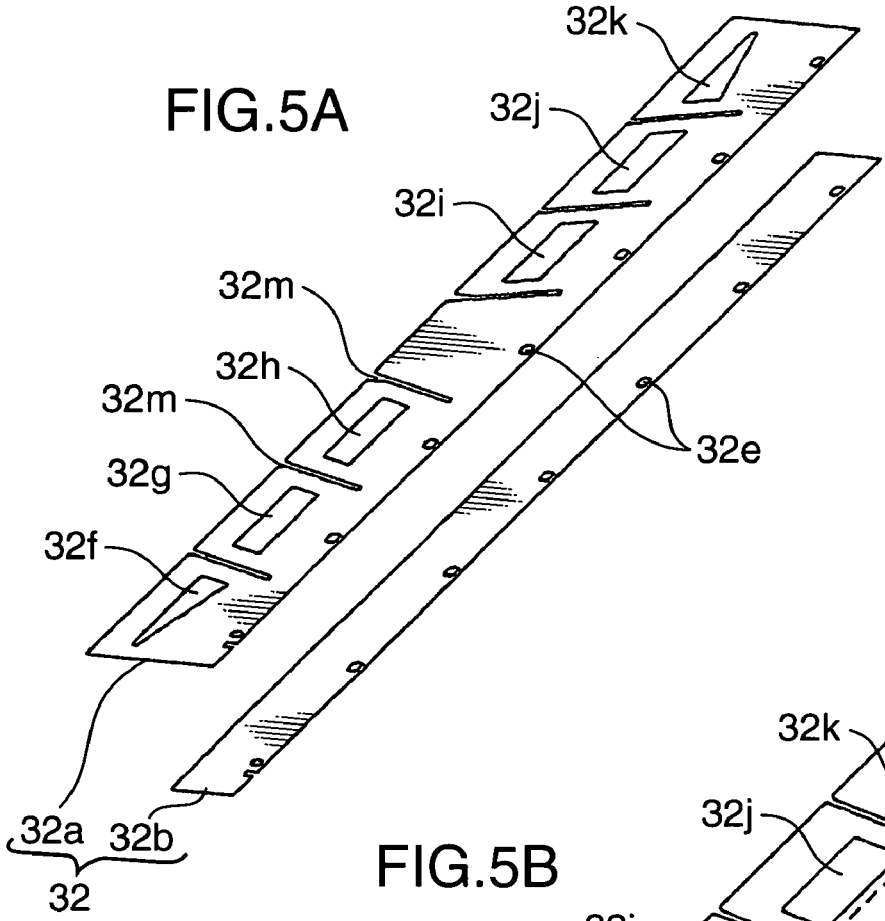

The stirring member 32 is constructed by a sheet made of a synthetic resin such as PET (polyethylene terephthalate), for example. Specifically, the stirring member 32 is constructed by placing two rectangular sheets 32*a* and 32*b* having substantially the same stiffness one over the other as shown in FIG. 5A. In the case of using PET sheets, the thickness of each sheet is appropriately 0.075 mm, for example. It should be noted that a thin sheet made of a metal such as SUS can be used for the stirring member 32 in place of the sheet made of synthetic resin such as PET.

Figure 4B:
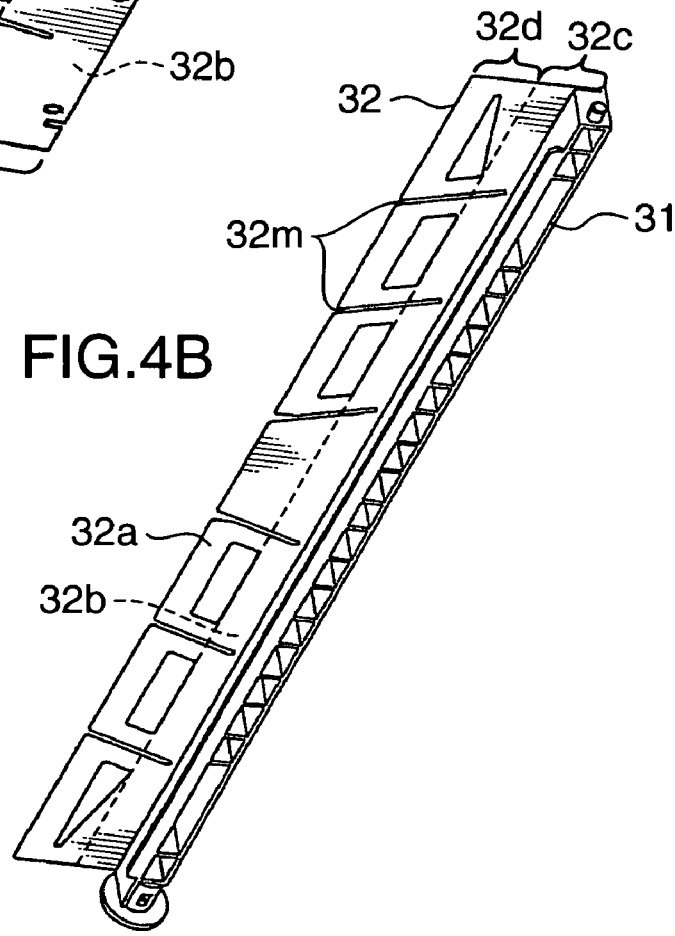

As shown in FIGS. 4A and 4B, the sheet 32*b* of the two sheets, which is on the upstream in the rotating direction of the rotating shaft 31 (the underside sheet in FIG. 4A), includes the attachment portion 32*c* having a projecting length L1. The other sheet 32*a*, which is on the downstream (the upside sheet in FIG. 4A), includes the attachment portion 32*c* having a projecting length L2 and a free end portion 32*d*. The projecting length L1 is preferably a half of the projecting length of L2. For example, in the case of the projecting length L2 being 40 mm, the projecting length L1 is about 20 mm.

The free end portion 32*d* of the sheet 32*a* on the downstream in the rotating direction includes a plurality of slits 32*m* (six in the present embodiment) extending in the direction perpendicular to the rotating shaft 31. Holes 32*f* to 32*k* are formed in respective areas separated by the slits 32*m*, except for a central area. The slits 32*m* allows the respective areas separated by the slits 32*m* in the free end portion 32*d* to curve flexibly in response to a pressure caused by toner, when the sheets are rotated.

The slits 32*m* are obliquely formed in such a manner that they converge to a center feeding line intersecting the rotating shaft 31 at a laterally center of the rotating shaft 31 in a plan view. With this configuration, areas closer to the center area bent in a greater amount. This configuration causes the end portion of each area to move greater than the portion of the area near to the rotating shaft 31. Consequently, toner particles T is gradually gathered in the central area of the sheet 32*a* on the downstream with the rotation of the sheet 32*a*.

Further, the holes 32*f* to 32*k* are formed in the sheet 32*a* on the downstream so that a reduced amount of toner comes into contact with the sheet 32*a* when being rotated. Consequently, only toner particles T on the free end portion 32*d* is fed to the next section, i.e., the toner container section 21*b* or the toner supplying section 21*a*. This arrangement makes it possible to feed a certain amount of toner particles T assuredly and to decrease the toner pressure on the sheet 32*a* on the downstream.

Further, the holes 32*f* and 32*k* formed in the both side areas of the sheet 32*a* on the downstream are shaped into a triangle having its base facing toward the center area of the sheet 32*a*. This configuration gives a stiffness to the leading end portion of the both side areas separated by the slits 32*m*. Therefore, when the sheet 32*a* on the downstream is rotated, the free end portion 32*d* of the both side areas having the smaller hole (triangle hole) and a smaller flexibility moves earlier than the inner side areas closer to the central area and having a larger hole (rectangular hole) and a larger flexibility. Accordingly, toner particles T remaining in a corner space in the toner container section 21*b* or 21*c* is gathered toward the center. It should be noted that the holes 32*g* to 32*j* except for the holes 32*f* and 32*k* in the sheet 32*a* on the downstream are shaped into a rectangle as large as possible so as to decrease the toner pressure on the sheet 32*a* on the downstream.

The stirring member 32 includes the two sheets 32*a* and 32*b* in such a manner that the sheet 32*b* on the upstream in the rotating direction (the underside sheet in FIG. 4A) and the sheet 32*a* on the downstream in the rotating direction (the upside sheet in FIG. 4A) are unified one over another. The attachment portion 32*c* of the stirring member 32 is inserted in the slit of the rotating shaft 31 so as to engage the hook hole 32*e* with the hook claw 31*a*, with the two sheets being unified one over another. Thus, the stirring member 32 is fixedly attached to the rotating shaft 31.

The stirring member 32 for the toner cartridge 20 includes the two sheets 32*a* and 32*b* unified one over another in the attachment portion 32*c* thereof (in the case of PET sheet having a thickness of 0.075 mm, a total thickness is 0.15 mm) and thus has a high stiffness. Meanwhile, the stiffness of the free end portion 32*d* of the sheet 32*a* is lower than the attachment portion 32*c* since the free end portion 32*d* is formed by the single sheet 32*a*.

Accordingly, as shown in FIG. 2A, toner particles T in the toner container section 21*b* is fed into the toner supplying section 21*a* by the stirring member 32 of the toner feeding mechanism 30(D) owing to the fact that the attachment portion 32*c* of the stirring member 32 having a high stiffness scoops up toner particles T in the toner container section 21*b* along the wall 21*e* standing on the downstream. Accordingly, the toner feeding rate of the stirring member 32 can be maintained.

As shown in FIG. 2B, even when the free end portion 32*d* of the sheet 32*a* on the downstream of the stirring member 32 is released from an upper end of the wall 21*e* (see the arrow b in FIG. 2B), little sound occurs due to a restoration of the stirring member 32 to the liner shape since the free end portion 32*d* has the low stiffness and a weak resilience.

In the embodiment, the stirring member 32 can obtain the high stiffness in the attachment portion 32*c* which is formed by unifying two synthetic resin sheets 32*a* and 32*b* one over another, and the low stiffness in the free end portion 32*d* by the one sheet 32*a*. Therefore, the production cost can be reduced. The stiffness can be adjusted by varying the thickness and/or the material of the two sheets 32*a* and 32*b*.

Further, the stirring member 32 includes the short sheet 32*b* having the projection length L1 on the upstream (the rear side) in the rotating direction, and the long sheet 32*a* having the projection length L2 on the downstream (the front side) in the rotating direction. Accordingly, the long sheet 32*a* on the downstream can be held with less flexibility by the short sheet 32*b* on the upstream. Therefore, the toner feeding rate of the stirring member 32 can be effectively maintained. The sheet 32*b* on the upstream in the rotating direction may be made to have an increased projecting length. In this case, the sheets 32*a* and 32*b* may be preferably adhered with each other by an adhesive agent.

Figure 5B:
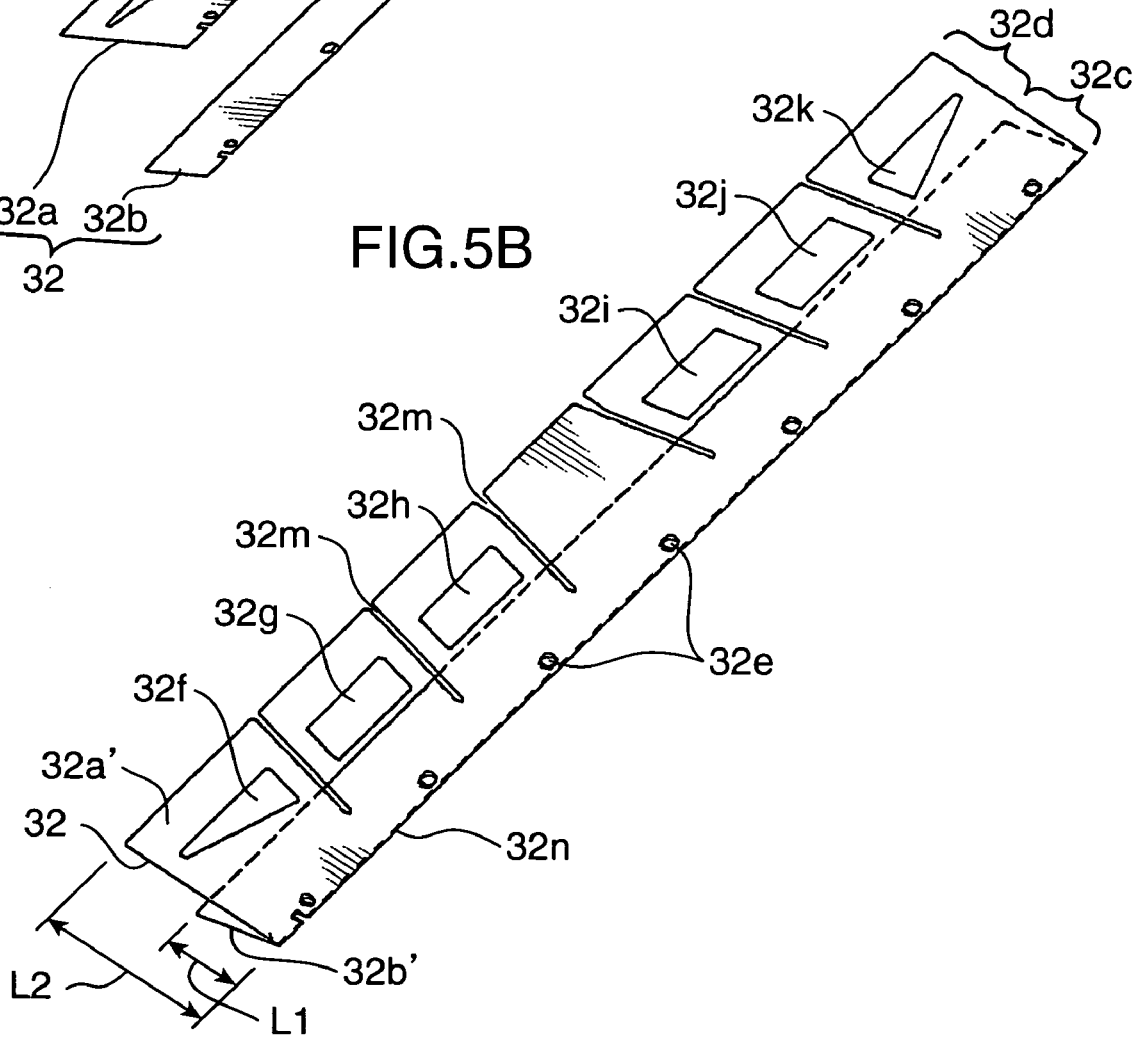

In the foregoing embodiment, the stirring member 32 is made up of the two synthetic resin sheets 32*a* and 32*b* unified one over another. However, as shown in FIG. 5B, it may be appreciated to form a stirring member 32 by folding a single synthetic resin sheet 32*n* into two. The one side 32*b*' of the folded sheet 32*n* is made to have a projecting length L1 defining an attachment portion 32*c*, and the other 32*a*' of the folded sheet 32*n* is made to have a projecting length L2 defining the attachment portion 32*c* and a free end portion 32*d*. In this case, folding the single synthetic resin sheet 32*n* into two produces the attachment portion 32*c* having the high stiffness of the combined two sheets, and the free end portion 32*d* including the low stiffness of the one sheet, thereby ensuring a reduced production cost.

In the foregoing embodiments, the stirring members 32 are provided in the toner feeding mechanisms 30(D) on the downstream and 30(U) on the upstream, respectively. However, the toner feeding mechanism 30(U) on the upstream may be provided with a stirring member having a single sheet (for example, the thickness is 0.125 mm), as conventionally.

Further, in the foregoing embodiments, the stirring member 32 is used in the toner container section 21*b* (21*c*) in the toner cartridge 20. However, it may be used in other section, such as the developing section 7 or cleaning section 16.

This application is based on patent application No. 2005-097477 filed in Japan, the contents of which are hereby incorporated by references.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. A toner supply device comprising:

a toner container for containing toner, a rotating shaft provided in the toner container, and a stirring member attached to the rotating shaft for stirring and feeding the toner to a supply opening formed in the toner container, wherein the stirring member includes an attachment portion fixedly attached to the rotating shaft and a free end portion having a stiffness lower than the attachment portion, and wherein the stirring member is formed by folding a single sheet in such a manner that one side of the folded sheet has a certain length and another side has a length longer than the one side.

2. A toner supply device according to claim 1, wherein the stirring member includes the one side in an upstream in a rotating direction, and the another side on a downstream.

3. A toner supply device comprising:

a toner container for containing toner having a toner containing section and a toner supplying section;

a stand wall constituting a vertical wall of the toner container;

a lid covering the toner container from a top thereof;

a rotating shaft provided in the toner container; and a stirring member attached to the rotating shaft for stirring the toner and feeding the toner by scooping up the toner along said stand wall to a supply opening formed in the toner supplying section;

wherein the stirring member includes a plurality of sheets having substantially the same stiffness and being unified one over another, and one sheet has a certain length and another sheet has a length longer than the one sheet in such a manner that a free end portion of the another sheet is brought into contact with an inner part of said lid other than a portion thereof that overlaps with said one sheet when the stirring member is released from an upper end of the stand wall.

4. A toner supply device according to claim 3, wherein the stirring member includes the one sheet in an upstream in a rotating direction, and the another sheet on a downstream.

5. A toner supply device comprising: a toner container having a toner containing section for containing toner, the toner containing section including a stand wall and a lid substantially opposed to the stand wall, the toner container further having a toner supplying section for supplying the toner to a developing section, a supply opening disposed between the stand wall and the lid and providing communication between the toner containing section and the toner supplying section of the toner container, a rotating shaft provided in the toner containing section and a stirring member attached to the rotating shaft for stirring the toner in the toner containing section and feeding the toner to the supply opening and into the toner supplying section, the stirring member including an attachment portion fixedly attached to the rotating shaft and a free end portion spaced outwardly from the rotating shaft, the free end portion having a stiffness lower than the attachment portion and having a dimension extending from the rotating shaft so that the free end portion of the stirring member deflects against the stand wall and the lid in response to rotation of the rotating shaft, the rotating shaft rotating in a direction so that the free end portion of the stirring member moves sequentially across the stand wall, the supply opening and then the lid.

6. A toner supply device according to claim 5, wherein the stirring member includes a plurality of sheets having substantially the same stiffness and being unified one over another, and one sheet has a certain length and another sheet has a length longer than the sheet.

7. A toner supply device according to claim 5, wherein the stirring member is formed by folding a single sheet in such a manner that one side of the folded sheet has a certain length and another side has a length longer than the one side.

* * * * *